United States Patent [19]

Taumann

[11] 4,300,055

[45] Nov. 10, 1981

[54] RADIATION FILTER

[75] Inventor: Leonhard Taumann, Lafayette, Calif.

[73] Assignee: Siemens Medical Laboratories, Inc., Walnut Creek, Calif.

[21] Appl. No.: 152,349

[22] Filed: May 22, 1980

[30] Foreign Application Priority Data

Jul. 3, 1979 [DE] Fed. Rep. of Germany ..... 2926883

[51] Int. Cl.[3] ..... G21K 5/04; H01J 35/02; H05H 7/12

[52] U.S. Cl. ..... 250/510; 250/505

[58] Field of Search ..... 250/510, 505

[56] References Cited

U.S. PATENT DOCUMENTS 4,121,109 10/1978 Taumann et al. ..... 250/510

*Primary Examiner*—Alfred E. Smith

*Assistant Examiner*—T. N. Grigsby

[57] ABSTRACT

The invention relates to an electron accelerator including an evacuated acceleration tube, a target exposed to the electron beam, an electron absorber following the target in beam direction, a collimator and a compensation body arranged therein centered on the axis of symmetry thereof. In such electron accelerators, used in radiotherapy, the soft radiation component is to be suppressed as much as possible. To this end the invention provides a filter plate made of heavy metal beyond the electron absorber, while the compensation body is made of a material of comparatively low atomic number. The filter plate may be inserted between the electron absorber and the compensation body. The target may be provided on the side of the electron absorber facing the acceleration tube.

7 Claims, 1 Drawing Figure

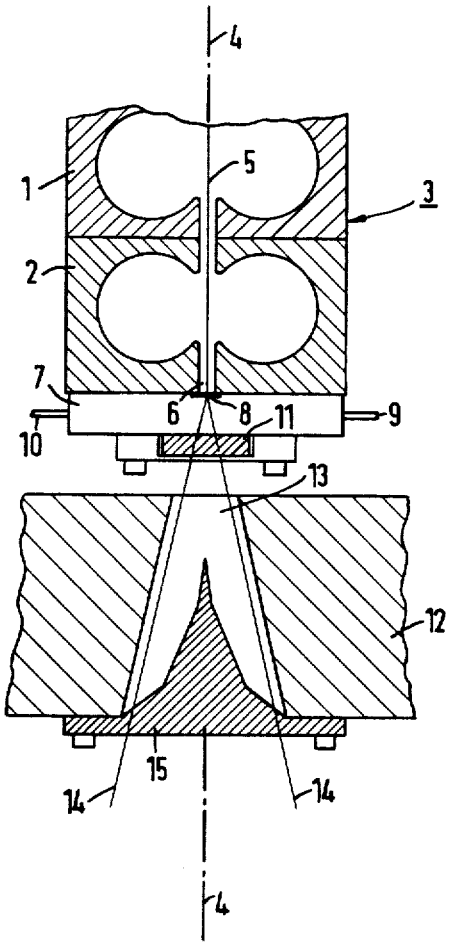
4
5
1
3
2
7
6
8
11
9
10
13
12
15
14
14
4

RADIATION FILTER

FIELD OF THE INVENTION

This invention relates to radiotherapy and more particularly to an electron accelerator including an evacuated electron acceleration tube providing an electron beam, a target exposed to the electron beam for generating an X-ray beam, an electron absorber following the target in beam direction, a collimator, and a compensation body arranged centered on the axis of symmetry of the masking aperture of the collimator.

BACKGROUND OF THE INVENTION

An electron accelerator intended preferably for use in medical radiotherapy is known as described in U.S. Pat. No. 4,121,109. In this electron accelerator a target is exposed to the electron beam issuing from the beam exit window of the acceleration tube. In beam direction beyond the target an electron absorber is arranged, through which the electrons remaining in the X radiation are filtered out. In beam direction beyond the electron absorber is a collimator for masking the roentgen ray field maximally being used. A compensation body made of low atomic number metal such as iron is secured on the collimator centered on the masking aperture thereof and extending into the body thereof. The compensation equalizes the radiation intensity over the total width of the roentgen ray field. In such an electron accelerator it is found to be disadvantageous that the low-energy X-ray component is relatively high.

To reduce the low-energy X-ray component, previously known apparatus uses a deflecting magnet which deflects the electron beam by 270° and focuses the electrons of a given energy. In this way the target is hit only be electrons of the selected acceleration energy. Such a deflecting magnet, however, is extremely expensive to construct and also requires considerable space between the beam exit window of the acceleration tube and the target. This, in turn, adversely affects the overall size of the accelerator.

SUMMARY OF THE INVENTION

It is therefore an object of the invention to achieve a hardening of the X radiation with simple means in an electron accelerator in which no deflecting magnet is used.

In an electron accelerator of the above-mentioned type therefore, in accordance with this invention, a filter plate made of heavy metal, e.g. lead is positioned in the X-ray path following the electron absorber, while the compensation body is made of a material of comparatively low atomic number, preferably aluminum. Thereby elements of higher atomic number weaken roentgen quanta of low energy relatively more than roentgen quanta of high energy, which means that over the entire ray cross-section there is greater absorption of those roentgen quanta whose energy lies in the absorption maximum of the material of the filter plate. In the case of the heavy metals entering into consideration for the filter plate, as for example uranium, tungsten, tantalum, gold and lead, especially those roentgen quanta are thus absorbed more which have energies between 1 and 3 MeV. This solution brings with it the particular advantage that by the aluminum compensation body itself no hardening of the radiation occurs, as would have been the case if it has been made of a material of higher atomic number, such as copper, or of course even more so lead. A hardening of the X radiation by the compensation body would, because of the different thickness of the compensation body, have led to an undesired hardening decreasing radially in the ray cone.

An especially appropriate embodiment of the invention is achieved by inserting the filter plate between the electron absorber and the compensation body. This has the advantage that the filter plate, because of the electron absorber preceding in beam direction, will not be hit by the main beam of electrons and therefore will not itself appear as a competing target. This being so, the selection of the filter material can focus exclusively on its fitness for hardening the X radiation. Moreover, the compensation body following the filter plate in beam direction is hit by X radiation which is extensively homogenized by the preceding filter plate.

An especially simple construction results if the target is disposed, in an advantageous embodiment of the invention, on the side of the electron absorber facing the acceleration tube. The target is supported by the electron absorber whose dimensions clearly must be greater than the target which generally consists of a lead foil only about 3 mm thick.

Apart from the improved mechanical protection, this solution also lays the basis for a further improvement of the design. The radiation load on the target can be increased significantly if, in an expedient form of the invention, the electron absorber is cooled. In this case, the electron absorber serves not only as a protective base for the target, but at the same time also as a cooling body, on whose solid wall coolants can easily be connected.

Further details of the invention will be explained with reference to the embodiment illustrated in the drawing.

THE DRAWING

The one FIGURE in the drawing shows a sectional view through the last two cavity resonators of an electron acceleration tube, through the target and through the collimator.

DETAILED DESCRIPTION OF THE PREFERRED EMBODIMENT

In the FIGURE, the last two disk type stacked cavity resonators 1 and 2 of an electron acceleration tube 3 of a linear accelerator are shown in cross section along their axes of symmetry 4. The axis of symmetry of the cavity resonators coincides with the electron beam 5. The exit aperture 6 of the last cavity resonator 2 is closed by the electron absorber 7 comprising a metal plate of high thermal conductivity, for example a copper plate 20 mm thick. This electron absorber 7 is soldered onto the last cavity resonator 2 gas-tight.

A disk-shaped target 8, only a few tenths of a millimeter thick, is soldered on the electron absorber 7 within a coterminous depression at the point where the electron beam 5 impinges. At the same time the electron absorber 7 may be provided with cooling channels which terminate in hose connections 9 and 10 for connection to any cooling system well known.

An X-ray filter plate 11 hereinafter described is mounted on the side of the electron absorber 7 opposite the target 8.

In beam direction beyond the electron absorber 7 and the filter plate 11 to a collimator 12 having a conical aperture 13 for passage of the X-ray filter beam 14. A compensation body 15 is secured to the collimator 12 to equalize over the total cross section of the X-ray field 14 maximally being used the intensity of the X radiation following a gaussian distribution curve.

During operation of the electron accelerator, the electrons accelerated by the acceleration tube 3 impinge directly on the target 8 which closes off the exit aperture 6. The target 8 will produce X-ray radiation. Waste heat created in the target 8 is transferred across the solder connection from the target to the electron absorber 7 where it dissipates preferably aided by a coolant.

The electrons passing through the target are decelerated and absorbed in the material of the electron absorber 7. For this reason, no further X radiation can be produced in the filter plate 11 disposed in beam direction beyond the electron absorber 7.

The filter plate 11 is of a meterial which has been selected solely on the basis of its ray absorption properties—an absorption factor as high as possible in the range of low-energy roentgen quanta of 1 to 3 MeV and as small an absorption factor in the range of the higher-energy roentgen quanta above 3 MeV. Suitable for this purpose are in particular the heavy metals lead, tantalum, gold, tungsten and uranium. In the present case there has been used for an electron energy of about 4 MeV a lead filter plate 2 mm thick. As the thickness of the filter plate 11 is constant over the entire beam cross section maximally being used, the hardening effect for the radiation is uniform over this entire beam cross section.

The compensation body 15 following in beam direction, therefore, need not and should not show any hardening effect. It can therefore be made of a material of low atomic number for which the absorption is approximately the same over the entire occurring X-ray energy spectrum. To this end aluminum is especially well suited.

The advantage of this construction is to be seen in particular in that the disadvantages connected with the omission of the expensive and bulky 270° deflecting and focusing magnet for the electron beam 5 can be offset to a large extent with respect to the beam quality by making the compensation body 15 of a material of low atomic number, e.g. aluminum, and inserting behind the electron absorber 7 a filter plate 11 which preferentially absorbs the roentgen quanta of low energy. This construction is not only less expensive; it also leads to much smaller equipment easier to position in medical application.

While a preferred embodiment has been described, modifications will be apparent within the scope of the following claims.

What is claimed is:

1. X-ray apparatus comprising an electron accelerator including an evacuated acceleration tube, a target exposed to the electron beam, an electron absorber following the target in beam direction, a collimator, and a compensation body made of a material of low atomic number positioned centrally on the axis of symmetry of the masking aperture of the collimator, the improvement comprising a filter plate made of heavy metal and having a high absorption of low energy X-rays and a lower absorption of high energy X-rays, positioned between the electron absorber and the compensation body.

2. The apparatus according to claim 1, characterized in that the filter plate is positioned on the side of the electron absorber opposite the target.

3. The apparatus according to claim 1, characterized in that the filter plate has a lead equivalent of at least 1 mm at an electron energy of 2 to 10 MeV.

4. The apparatus according to claim 1, characterized in that the target seals the acceleration tube vacuumproof on the beam exit side.

5. The apparatus according to claim 1, characterized in that the target is disposed on the side of the electron absorber facing the acceleration tube.

6. The apparatus according to claim 5, characterized in that the electron absorber is cooled.

7. The apparatus according to claim 5, characterized in that the electron absorber seals the acceleration tube vacuumproof on the beam exit side.

* * * * *